US006711759B1

(12) United States Patent
Kluckhuhn

(10) Patent No.: US 6,711,759 B1
(45) Date of Patent: Mar. 30, 2004

(54) TRANSFER SYSTEM FOR AN INVALID PATIENT

(76) Inventor: Gary R. Kluckhuhn, 2180 Sandpiper St., Naples, FL (US) 34102

( * ) Notice: Subject to any disclaimer, the term of this patent is extended or adjusted under 35 U.S.C. 154(b) by 0 days.

(21) Appl. No.: 10/302,707

(22) Filed: Nov. 25, 2002

(51) Int. Cl.[7] ..... A61G 7/14

(52) U.S. Cl. ..... 5/81.1 R; 5/83.1; 5/85.1

(58) Field of Search ..... 5/81.1 R, 83.1, 5/85.1, 88.1, 89.1, 81.1 C, 81.1 RP, 81.1 HS

(56) References Cited

U.S. PATENT DOCUMENTS

| | | | | | |
|---|---|---|---|---|---|
| 408,716 | A | * | 8/1889 | Holton | 5/85.1 |
| 662,477 | A | * | 11/1900 | Ulrich | 5/85.1 |
| 1,072,959 | A | * | 9/1913 | Kincannon | 297/338 |
| 1,332,624 | A | * | 3/1920 | Goodwin | 5/89.1 |
| 1,385,424 | A | * | 7/1921 | Billings | 5/85.1 |
| 1,971,294 | A | * | 8/1934 | Bunker | 5/89.1 |
| 2,638,657 | A | * | 5/1953 | Arnold | 27/28 |
| 3,123,224 | A | * | 3/1964 | Kral | 212/330 |
| 3,351,959 | A | * | 11/1967 | Turpin | 5/83.1 |
| 4,125,908 | A | * | 11/1978 | Vail et al. | 5/83.1 |
| 4,190,912 | A | * | 3/1980 | Nilsson | 5/83.1 |
| 4,202,064 | A | * | 5/1980 | Joergensen | 5/83.1 |
| 4,243,147 | A | * | 1/1981 | Twitchell et al. | 212/284 |
| 4,256,098 | A | * | 3/1981 | Swan et al. | 5/85.1 |
| 4,372,452 | A | * | 2/1983 | McCord | 212/285 |
| 4,627,119 | A | * | 12/1986 | Hachey et al. | 5/85.1 |
| 4,639,955 | A | * | 2/1987 | Carminati et al. | 5/85.1 |
| 4,658,451 | A | * | 4/1987 | Taniguchi | 5/607 |
| 4,739,526 | A | * | 4/1988 | Hollick | 5/83.1 |
| 4,944,056 | A | * | 7/1990 | Schroeder et al. | 5/85.1 |
| 5,016,300 | A | * | 5/1991 | Jandrakovic | 5/85.1 |
| 5,072,840 | A | * | 12/1991 | Asakawa et al. | 212/312 |
| 5,123,131 | A | * | 6/1992 | Jandrakovic | 5/85.1 |
| 5,147,051 | A | * | 9/1992 | Liljedahl | 212/71 |
| 5,158,188 | A | * | 10/1992 | Nordberg | 212/312 |
| 5,235,711 | A | * | 8/1993 | Jandrakovic | 5/87.1 |
| 5,327,592 | A | * | 7/1994 | Stump | 5/81.1 R |
| 5,456,655 | A | * | 10/1995 | Morris | 601/23 |
| 5,490,293 | A | * | 2/1996 | Nilsson | 5/83.1 |
| 5,499,408 | A | * | 3/1996 | Nix | 5/85.1 |
| 5,511,256 | A | * | 4/1996 | Capaldi | 5/83.1 |
| 5,530,976 | A | * | 7/1996 | Horcher | 5/89.1 |
| 5,623,948 | A | * | 4/1997 | Van Morris | 5/81.1 R |
| 5,737,781 | A | * | 4/1998 | Votel | 5/81.1 HS |
| 5,809,591 | A | * | 9/1998 | Capaldi et al. | 5/83.1 |
| 5,890,238 | A | * | 4/1999 | Votel | 5/81.1 HS |
| 6,006,377 | A | * | 12/1999 | Asakawa | 5/83.1 |
| 6,085,368 | A | * | 7/2000 | Robert et al. | 5/85.1 |
| 6,174,010 | B1 | * | 1/2001 | Fanger et al. | 294/81.4 |
| 6,341,393 | B1 | * | 1/2002 | Votel | 5/81.1 T |
| 6,378,148 | B1 | * | 4/2002 | Votel | 5/81.1 HS |
| 6,389,618 | B1 | * | 5/2002 | Flynn | 5/81.1 R |
| 6,523,195 | B1 | * | 2/2003 | Rodier et al. | 5/83.1 |
| 6,532,607 | B1 | * | 3/2003 | Heil | 5/85.1 |
| 6,568,003 | B1 | * | 5/2003 | Vest | 5/89.1 |
| 2003/0061656 | A1 | * | 4/2003 | Heil | 5/81.1 R |
| 2003/0140816 | | * | 7/2003 | Bergeron | 104/89 |

FOREIGN PATENT DOCUMENTS

| | | | | | |
|---|---|---|---|---|---|
| EP | 27638 | A | * | 4/1981 | A61G/5/00 |
| FR | 2354755 | A | * | 2/1978 | A61G/7/10 |
| GB | 2227224 | A | * | 7/1990 | A61G/7/10 |
| WO | 8202146 | A | * | 7/1982 | A61G/7/10 |

* cited by examiner

*Primary Examiner*—Robert G. Santos
(74) *Attorney, Agent, or Firm*—Werner Schroeder

(57) ABSTRACT

The invention is directed to an invalid patient transport system from point A to point B. The system is suspended from a ceiling and can move relative thereto in a first movement The system has a second movement to be able to turn relative to the ceiling in different directions. The transport system further has a third movement and that is an up and down movement relative to the ceiling. The system further has a fourth movement and that is to move a seating assembly under a patient and between the location the patient is sitting or reclining on.

23 Claims, 11 Drawing Sheets

TRANSFER SYSTEM FOR AN INVALID PATIENT

BACKGROUND OF THE INVENTION

The present invention relates to a transfer system that uses conveyor belts. The system is most useful in the medical field, although other uses are contemplated. In the medical field the system is most useful in transferring aged, sick or invalid persons from one location to another for various reasons. It is known that more than one person is required to move a patient which is very cumbersome and creates a great discomfort for the patients. Various devices have been developed in the transfer of people, especially disabled patients, from one location to another.

U.S. Pat. No. 3,150,757 shows a moving sidewalk using two opposed en belts having upper and lower runs operating in opposite directions while both inner runs are contiguous to each other and running in the same direction. This basic principle is used in the invention at hand.

U.S. Pat. No. 3,418,670 discloses opposing belts to using a small upper roller assembly that is disposed for receiving a patient in which the patient is eased onto the small roller assembly and then it provides for pulling the patient onto a stretcher as the stretcher moves under the patient. A crank arm turns a worm gear to drive the lower belt which then drives the upper belt by frictional engagement therewith.

U.S. Pat. No. 3,608,104 illustrates a carrying assembly to lift and transport a disabled person. The device includes two lateral plates which are moved toward each other and under the patient who remains in a seated portion U.S. Pat. No. 3,854,152 shows a patient transfer device which includes two roller supported endless belts disposed one above the other. The lower endless belt drives both belts toward the patient while the upper endless belt is moving in the opposite direction via drive means attached to the plurality of the rollers.

U.S. Pat. No. 4,680,818 shows a device for moving a recumbent person includes a base plate, an insertion plate and a pair of rollers having a belt trained around the same which belt can be wound to and from each of the rollers while the belt is trained around the base plate.

U.S. Pat. No. 5,283,917 shows a device for lifting or positioning a person which includes a base, a multiplicity of supporting elements for the body of the person and positioning device connecting the base to the supporting elements. This device does use any opposing conveyor belts.

U.S. Pat. No. 5,411,279 discloses a multiple belt conveying device that includes at least one endless inner belt which is movably wound on at least one substrate plate further included is an outer endless belt movably mounted on a front roller. The outer belt movably overlaps the with an inner surface of the outer belt frictionally contacting the outer frictional surface of the inner belt.

U.S. Pat. No. 5,540,321 shows the use of opposing belts as a means for moving objects. An endless upper and an endless lower belt are each trained around a pair of rollers while the inner surface of the upper belt and the upper surface of the inner belt are in contact with each other and are moving in unison when one of the rollers is driven in either direction.

U.S. Pat. No. 5,946,748 discloses a body turning apparatus. This apparatus does use any endless conveyors to accomplish the task at hand.

BRIEF SUMMARY OF THE INVENTION

An object of the invention is to construct a device that can easily pick up any object, particularly a patient, without having to move the patient, lift the patient and transport the patient by either an overhead conveyor mechanism or an apparatus that is movable on the ground. The invention includes a conveyor system making the use of at least two endless conveyor belts, although one of the ends of the endless of the belts is tethered at the point of origin that are trained around a pair of front and a pair of rear rollers.

The overall system executes at least four motions, that is, number one, to move the patient along a track to a desired location, that is anywhere in a building.

Number two to pick up a patient in any location that is, from a mattress, a chair, a floor, from a bath tub or from a wheel chair.

The second motion is to transport the patient from any point in a building, by an overhead transport system.

The third motion is to move a patient vertically from a low position, that is, from the floor to a position such as a chair or the entrance into a bathtub.

The fourth motion is to employ a seat under the patient to engage the bottom of the patient to be freed from any encumbrance the patient is sitting on.

DETAILED DESCRIPTION OF THE INVENTION

Figure 1:
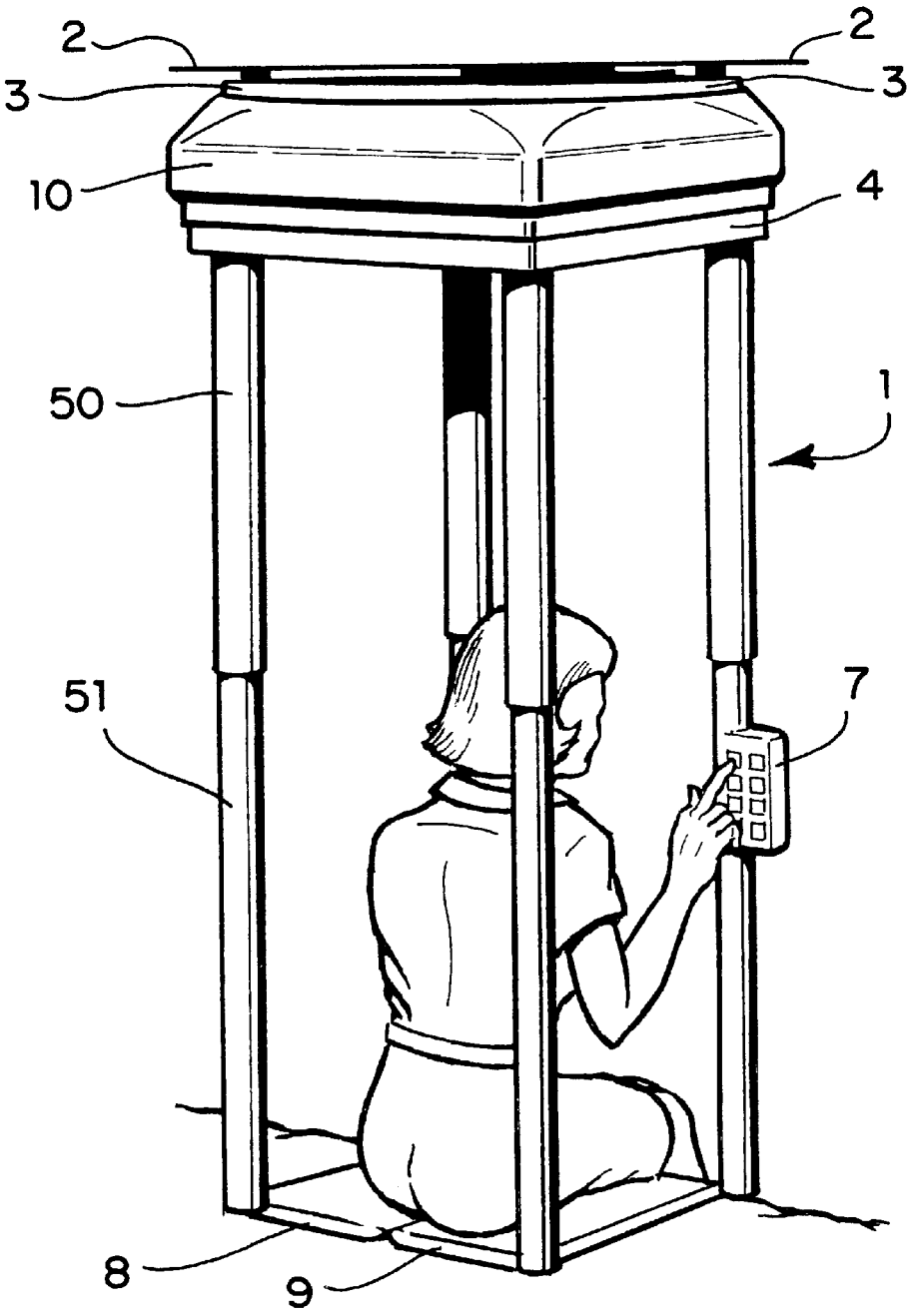
FIG. 1 shows the overall device which can be moved in many different modes and directions.

FIG. 1 shows the overall patient transfer system 1 as it is deployed to transfer a patient from one point to another. The system 1 consists of a ceiling supported upper unit 3 which is supported from the ceiling 2. There is a lower support unit 4 which is mounted to the support unit 3 which will be explained below. There is a left 8 and a right 9 seat support assembly to support a patient during transport. This will be explained with reference to later Figs. Also shown in FIG. 1 are the inner shaft housing 51 and the outer shaft housing 50 which are telescoping relative to each as the seating unit moves up and down to varies positions. The operations within the outer shaft housing and the inner shaft housing will be explained with reference to FIG. 4. Also shown in FIG. 1 is the control display for the patient to control the at least four different motions of the patient transfer unit 1.

Figure 2:
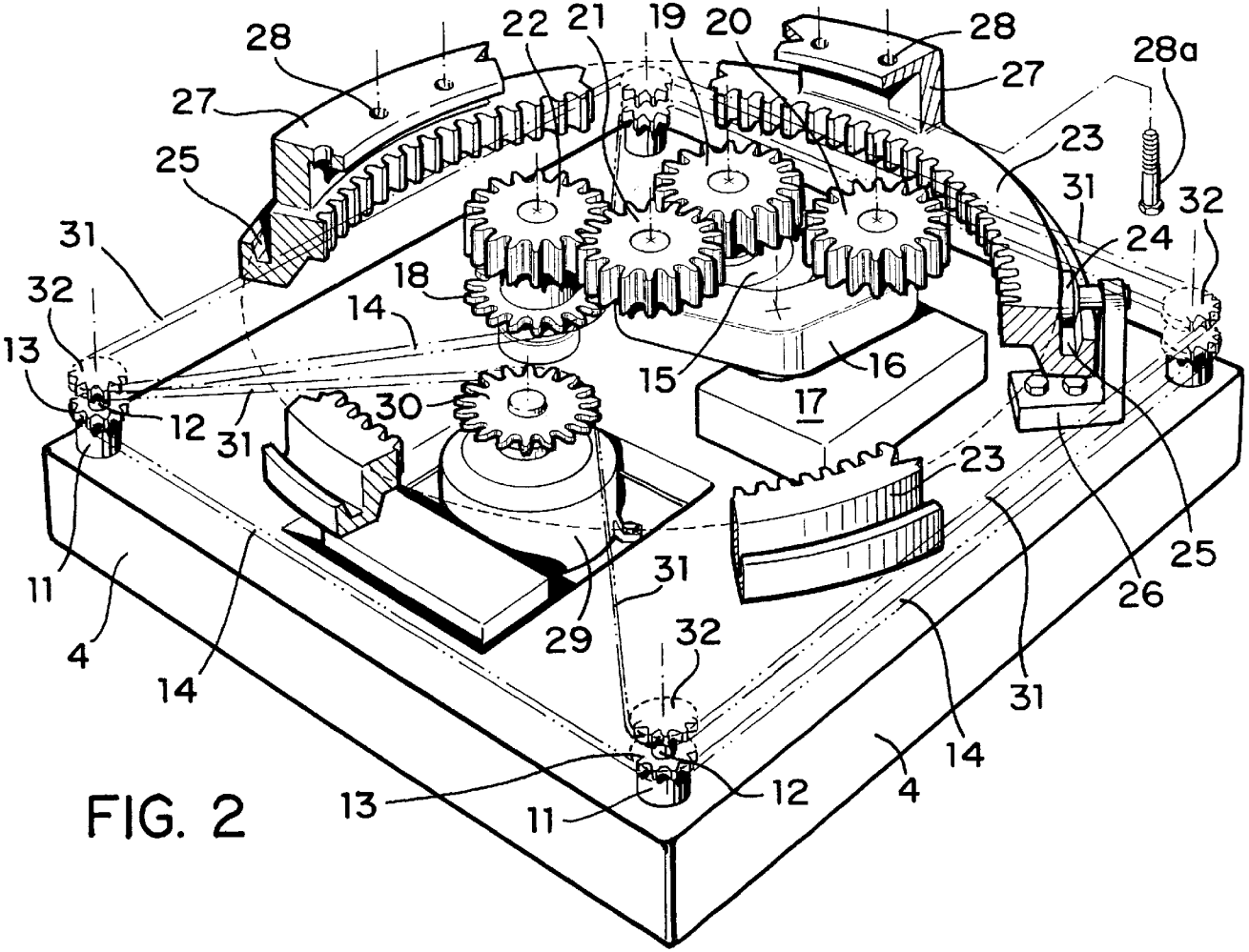
FIG. 2 shows the device and the mechanism that will drive the transfer system in at lest three different driving modes.

FIG. 2 illustrates the lower support unit 4 in detail. To this end, the lower support unit 4 is mounted to the upper support unit 3 by way of the brackets 27 having the holes 28 through which the bolts 28*a* pass to be fastened to the upper unit 3. This unit 4 will initiate three driving motions. The first one will perform a movement of the unit 4 relate to the ceiling 1, that is will rotate the unit 4 relative to the ceiling 1. The support unit 4 has at an upper section thereof a gear ring 23 mounted together with the brackets 27. The whole unit 4 is rotated by the driven gear wheel 20 which is mounted on a pivot arm 16 which in turn is controlled by the control unit 17 which causes the control arm 16 to swing into two different positions. In a first position, the gear 20 will be engaged with the teeth on the gear ring 23. The gear wheel 20 is driven by a motor 15 which is located adjacent to the pivot arm 16 and concentric therewith. When the control arm 16 swings into a first position, the gear wheel 20 will engage the ring gear 23 to thereby rotate the whole support unit 4 relative to the ceiling. The rotation of the support unit 4 is made possible because the support unit 4 is supported on rollers 24 which are mounted on the bracket 26 and the rollers 24 are running in a roller channel 25 which is part of the ring gear 23. With other words, the ring gear 23 is stationary on the support unit 3 while the support unit 4 may rotate relative thereto.

Turning now to the second drive motion on the support unit 4 and that is the drive for the seat deployment which will described in more detail below. The support unit 4 supports a drive motor 29 having a chain sprocket wheel 30 mounted thereon. The upper chain 31 is driven by the motor 29. The upper chain 31 is trained around the sprocket wheels 32 on all four corners of the support unit 4. Each of the sprocket wheels 32 is connect to downwardly oriented shafts 12 at all four corners. These shafts are concealed within the inner and outer shaft housings 50 and 51 of FIG. 1 which are telescoping relative to each as will explained below. In this particular drive, when the pivot arm 16 swings to its second position, the gear wheel 21 will engage the driving gear wheel 19 on the motor 15 to thereby drive the driven gear wheel 22 which carries a chain sprocket wheel 18 thereon. The sprocket wheel 18 has a lower drive chain 14 trained there around which in turn will drive the sprocket wheels 13 located on all four corners of the support unit 4. All four sprocket wheels 13 drive an outer shaft 11 which is concentric with the earlier described inner shaft 12 which drives the seat employment system. The presently described shafts 11, being driven by the sprocket wheels 13, are responsible for driving the elevation system of the patient's seat which will be described below.

Figure 3:
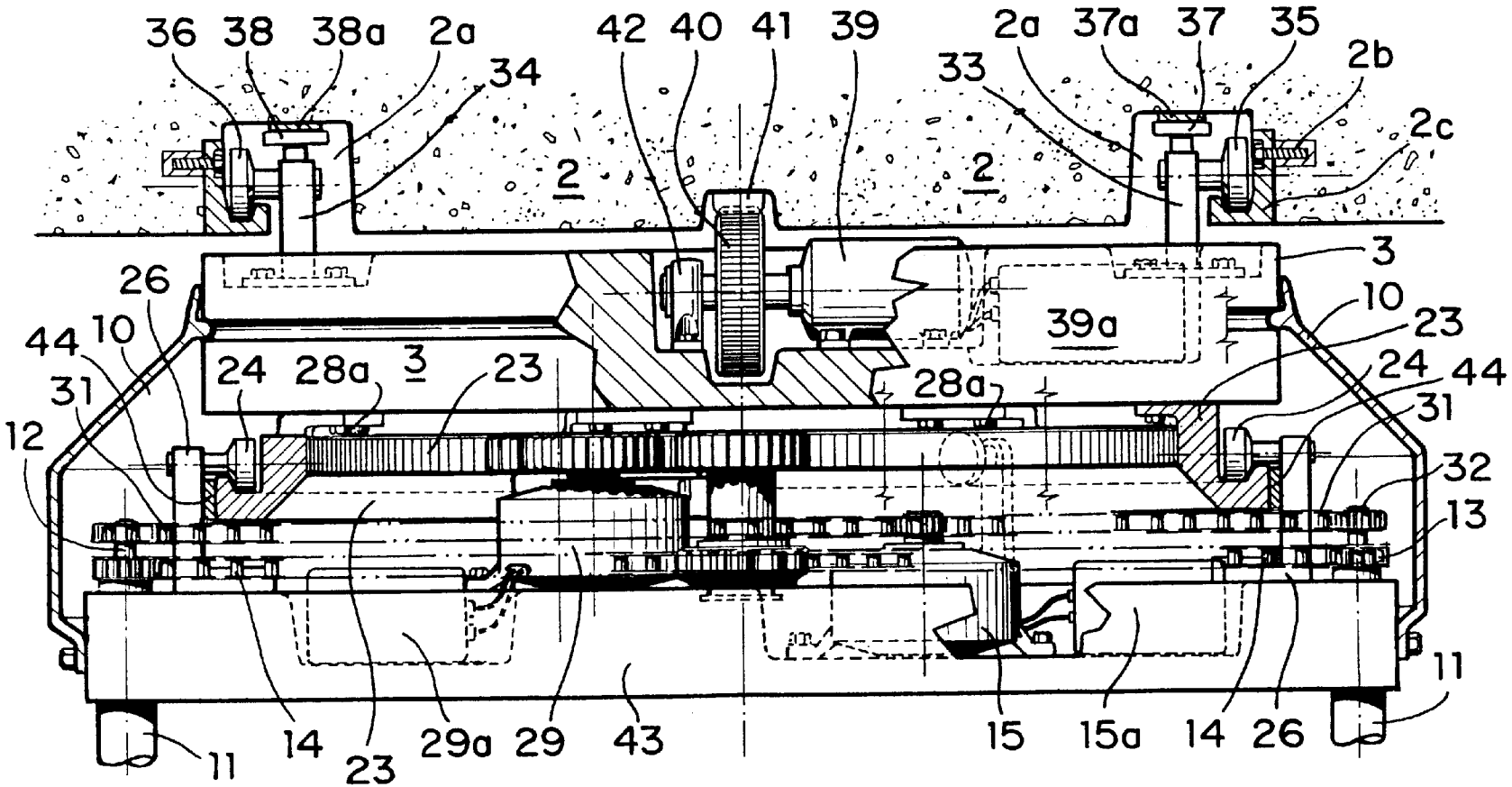
FIG. 3 illustrates a cross section of FIG. 2 including a fourth motion of driving.

FIG. 3 shows the support unit 4 in cross section. In this FIG. 3 like reference characters have been applied to the same characters as were applied in FIG. 2. This FIG. 3 illustrates how the overall movement of the device 1 is accomplished relative to the ceiling from which the device is suspended. As shown in FIG. 3, the overall unit 1 is suspended from a track system which is contained in a well 2*a* system within the concrete 2 of the ceiling. Two longitudinal tracks 2*c* are mounted within the well 2*a* by way of bolts 2*b*, the upper support unit 3 has left and right brackets 34 and 33 attached thereto which brackets support left and right support rollers 36 and 35 thereon. The roller 36 and 35 run within the tracks 2*a* to thereby be able to move the support unit 3 relative to the ceiling. Movement of the overall system is accomplished by a drive motor 39 which is supported by the pillow block 42. The motor drives a driving pinion which is engaged in a gear track 41 located in a well of the ceiling. The motor 39 is supplied with power by a low voltage power battery 39*a* which battery receives recharging power from the left and right electric slide connections 38 and 37 by way of left and right power tracks 38*a* and 37*a*.

It should be pointed out at this time that the tracks for supporting the overall system do not have to be mounted within a well in a ceiling but could instead be mounted flush with the ceiling From FIG. 3 it can also be seen that a cover shroud 10 is mounted between the stationary unit 3 and the rotating unit 4 so that it can act as protection against dust and dirt. The shroud 10 is connected to the supporting unit 4 so it can rotate relative to stationary unit 3.

FIG. 3 further shows the power supply to the motor 15 by way of a low voltage battery 15*a* and at the same power of supply to the motor 29 is shown by the battery 29*a*. Also, FIG. 3 shows the lower support unit at or 43.

Figure 4:
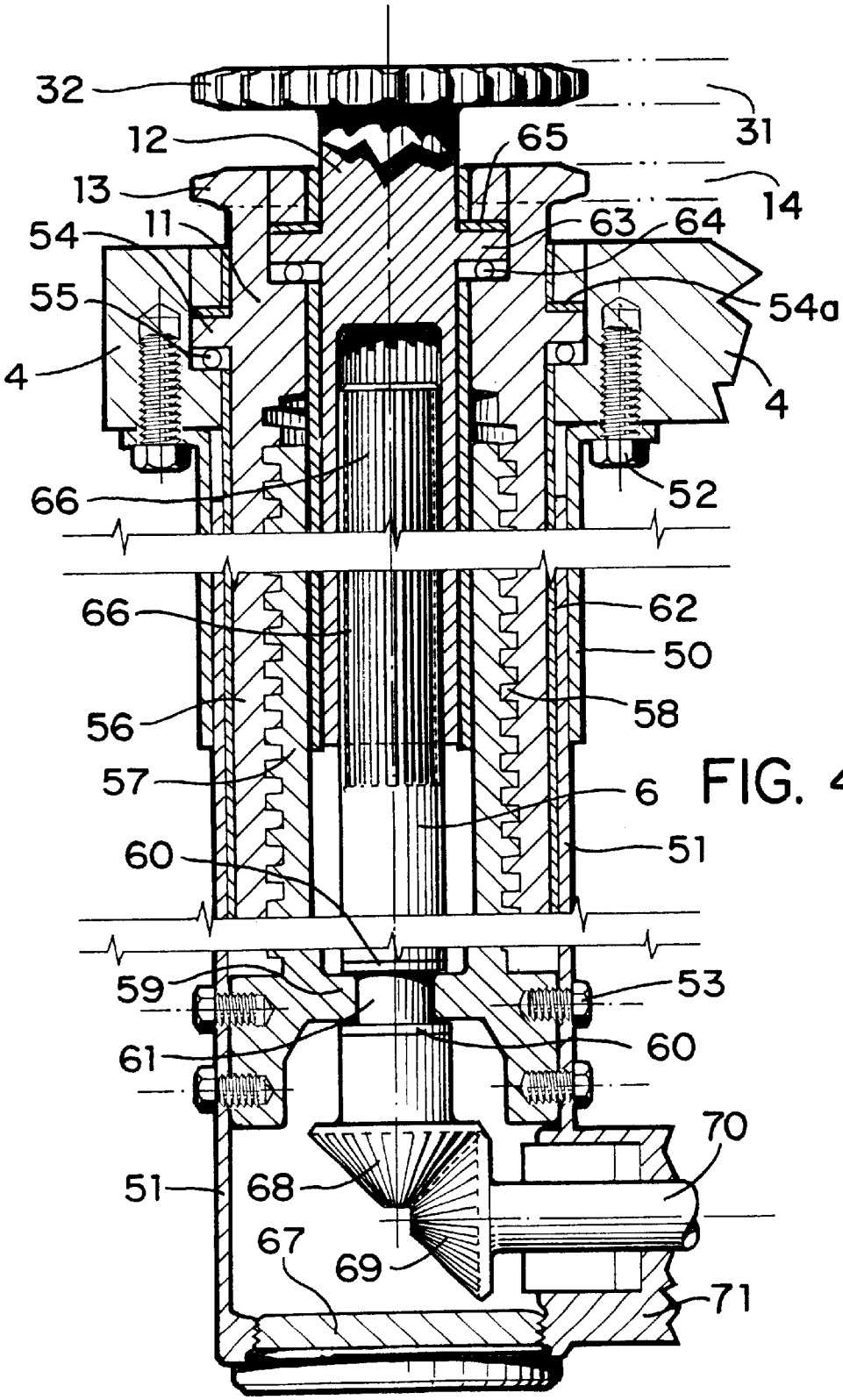
FIG. 4 shows a cross section of the downward driven mechanism including at least three drive motions.

FIG. 4 shows the downward drive of the various shafts as they are derived from the support unit 4. A section of the support unit 4 is clearly shown at the top of FIG. 4. Again, like references are shown as they were applied to earlier Figs. The upper sprocket wheel 32 as shown in FIGS. 2 and 3 drives the downwardly extending shaft 12 which in turn drives the lower extending shaft 6 to drive the seat employment system, since the shafts 12 and 6 can move relative to each and still maintain driven rotation, the two shafts 12 and 6 are splined to each other by splines 66. Therefore, the two splines can move up and down as to what the system requires but still will maintain driving contact, the lower part of shaft 6 has a circular recess 61 therein so that a connecting lug on the shaft 6 can engage within this recess 61 to keep control of the height of the shaft 6 when the system is moving up or down.

The lower sprocket wheel 13 by way of the chain 14 drives the elevating shaft 11, the outer shaft 11 is held in a position so that it only can rotate relative to the support unit 4 but cannot move up or down. This is so because the outer shaft 11 has an outer extension ring 54 there around which is rotatably fitted within a circular recess within the support unit 4. It is supported by a bearing 55 and a non-frictional bushing 54*a*. The bushing 54*a* could be made of TEFLON™ which is known to be a self-lubricating material. The outer housing 11 has supported therein a second outer housing shaft 57. The connection between the outer shaft and the second is by way of telescoping screw threads 58. That means, when the outer shaft 11 is being rotated by the sprocket wheel 13 the second outer shaft 57 is moving within the outer shaft 11 either up or down depending on the directional rotation. The lower end of the second outer housing shaft 57 has a circular connecting lug 59 thereon which fits into the circular recess 61 of the inner shaft 6. This means, that when the second outer shaft 57 is moving up or down, the inner shaft 6 must follow this movement. There is a thrust bearing between the second outer shaft 57 and the inner shaft 6 at 60 to aid in the rotation between the two shafts.

In order to protect the moving shaft from any damage and to protect a patient from getting entangled within the shafts and the gears, there is provided an upper protective sleeve 50 which is fastened to the support unit 4 by bolts 52. Then there is a lower protective sleeve 51 which is mounted to the second outer shaft 57 by bolts 53. These two sleeves are shown at 50 and 51 in FIG. 1 also. The inner shaft 6 has at its lower end a miter gear 68 provided which meshes with the miter gear 69 fastened to the horizontal shaft 70. These gears 68 and 69 drive the seat employment system which will be explained below. It should be understood that there are four driving systems as shown in FIG. 4 for each corner of the overall system. The other driving systems are mere mirror images of the one shown and explained. A pair of the driving system of FIG. 4 work in tandem to be able to extend the seat system 8 and 9 as is shown in FIG. 1. For this purpose, there is shown a horizontal connecting bar at 71 in FIG. 4 which will appear in later Figs.

Figure 5:
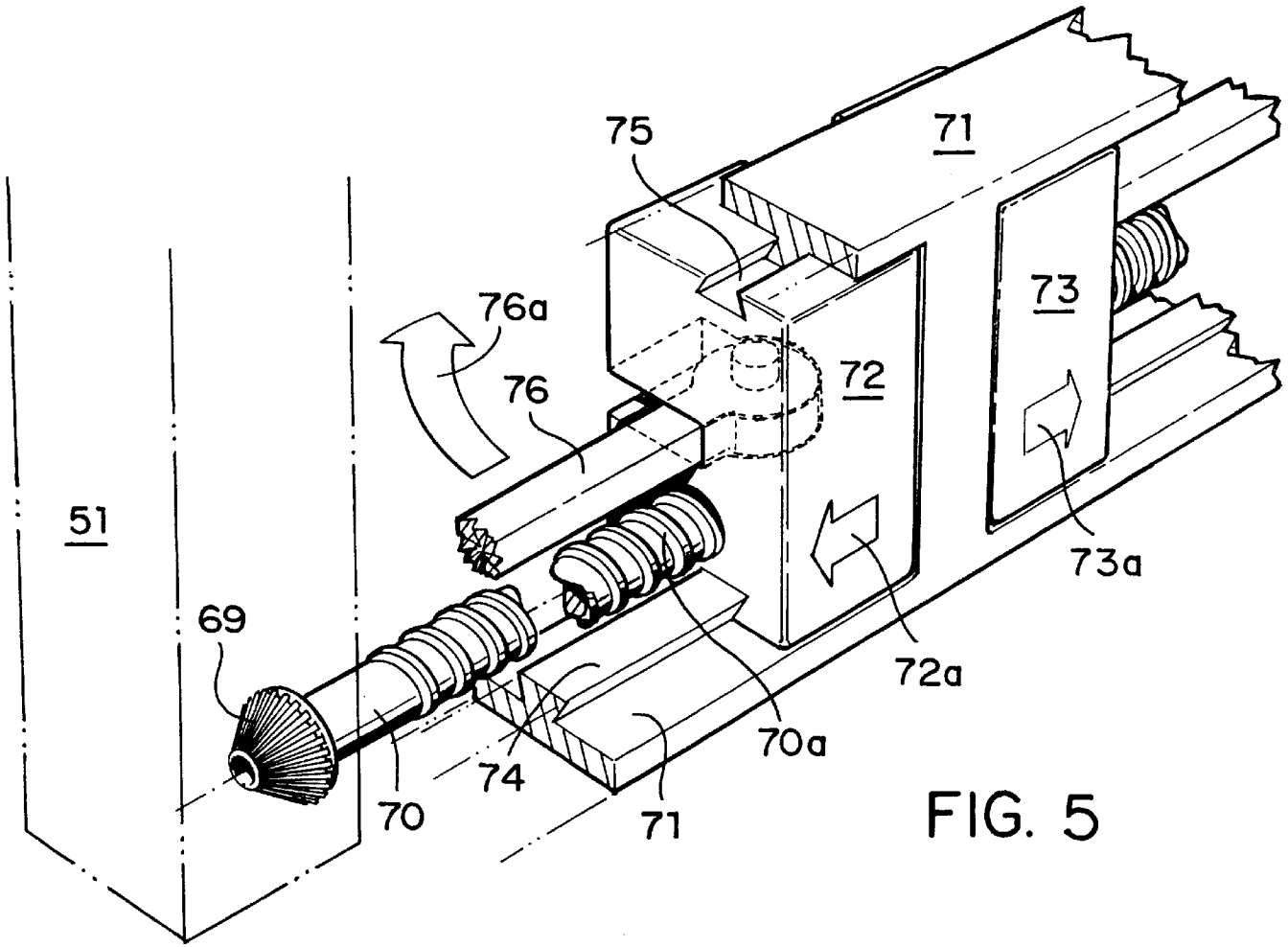
FIG. 5 shows the mechanism for driving the seat control including one of the three driving motions.

FIG. 5 shows the mechanism for employing the two seat halves 8 and 9 toward or away from each other. In this FIG. 5 the connecting bar 71 can be seen in part detail. The connecting bar 71 is extended toward each corner with one corner shown in phantom as the inner shaft housing 51. The connecting bar 71 has upper and lower tracks with the lower slide dovetail 74 and the upper dovetail at 75. There is a left slide block 72 and a right slide block at 73. Both slide blocks are received within their respective dovetails in the horizontal connecting bar 71. At the left side of FIG. 5 there is shown the miter gear 69 which was identified in FIG. 4. There is also shown the horizontal drive shaft 70 also shown in FIG. 4. The drive shaft 70 has helical gear threads 70*a* thereon which mesh with inner helical gear threads (not shown) within the blocks 72 and 73.

At the center of the shaft 70 the helical gear threads change directions so that the two blocks 72 and 73 can move away or toward each other as is indicated by the arrows 72*a* and 73*a*. In FIG. 5 there is also shown linking bar 76 which will move in the direction of 76*a* when block 72 is activated. This movement will be explained below.

Figure 6:
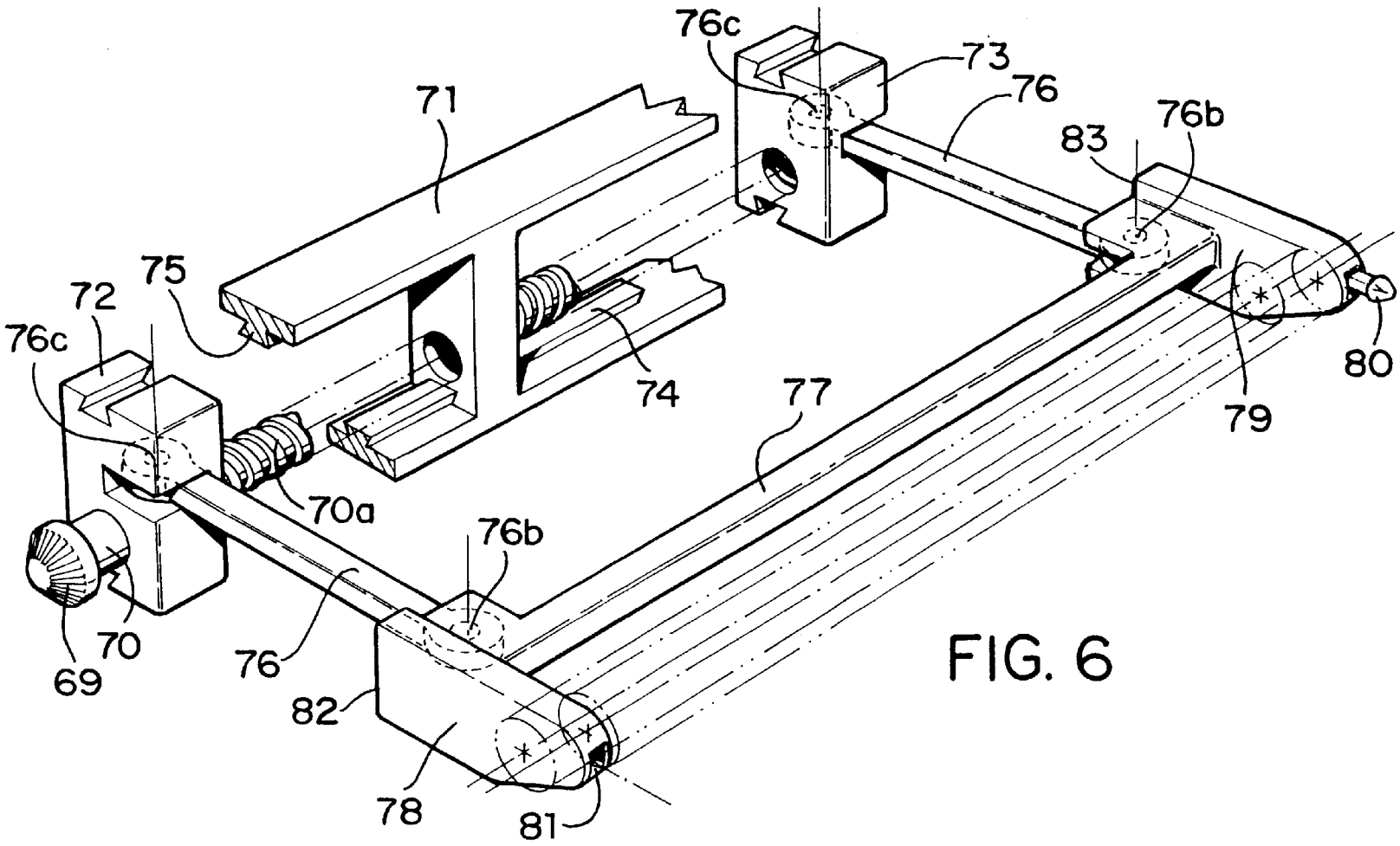
FIG. 6 shows a different view of the mechanism for driving the seat assembly in an employed or extended condition.

FIG. 6 illustrates an extended view of the one half of the seat system. This view shows the blocking blocks 72 and 73 fully extended from the center location of FIG. 5. As can be seen in this view, the two linkage bars 76 have moved from their straight positions in FIG. 5 to a position where they are parallel to each other and at opposed corners of the overall system. The linkage bars 76 are pivoted to their respective blocks 72 and 73 by way of pivots 76*c*. The forward ends of the linkage bars 76 are pivoted at 76*b* to respective ends of a rigid cross bar 77. The respective cross bar 77 has connecting blocks 78 and 79 thereon to rigidify the various elements.

On the left side of the cross bar 77 and on the respective block 78 there is provided a female receiving recess 81 while on the right side of the cross bar 77 and at the forward end of the connecting block 79 there is provided a male connecting bolt 80, when the two halves of the seat assembly meet at the center and are fully deployed, the male connecting bolt 80 will seat in the female recess to thereby rigidify both halves of the seat assembly and will be able to safely support a patient thereon even when above normal weight.

Figure 7:
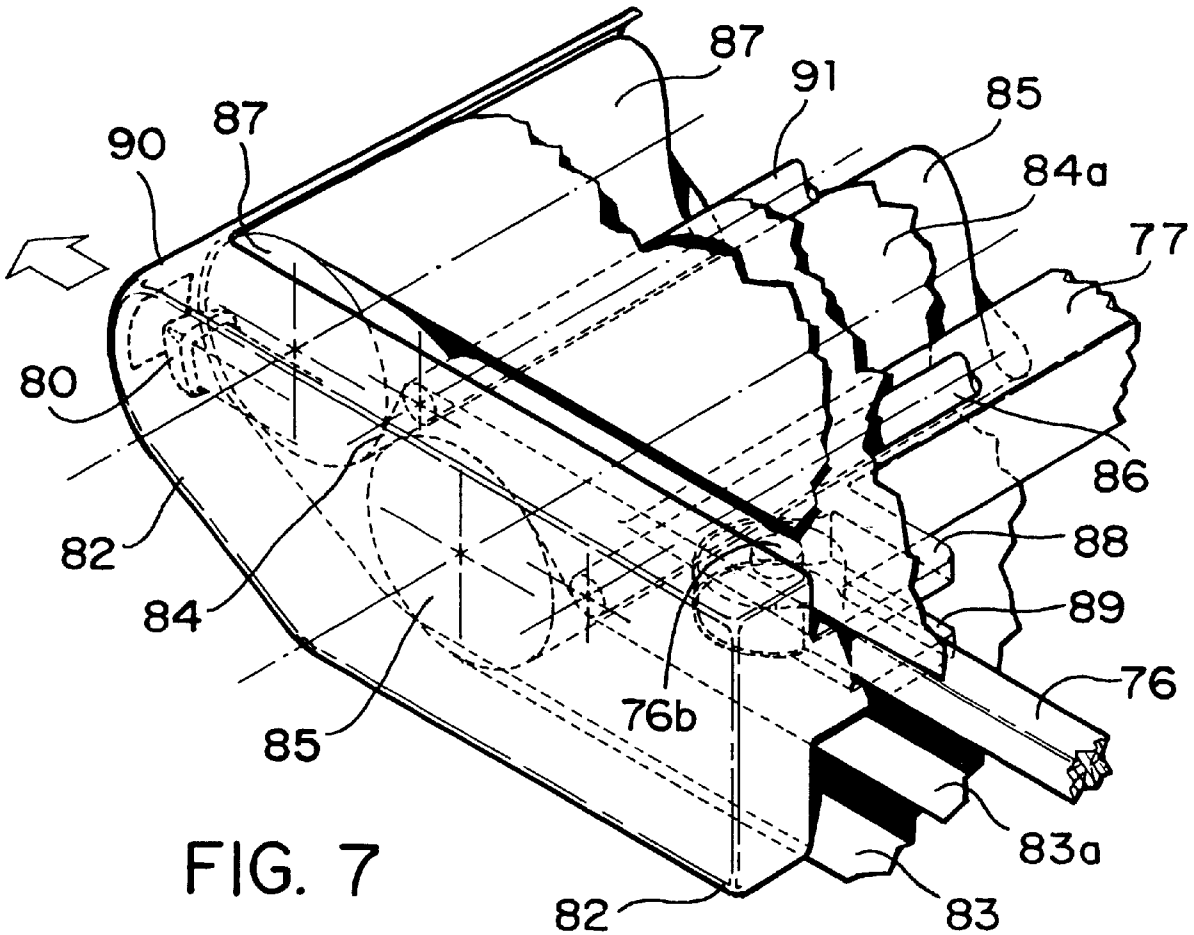
FIG. 7 is a view of the view of one forward end in an employed condition including the rollers having a web trained around them.

FIG. 7 shows an outside corner of a fully extended half of a seat assembly. In this view there can be seen forward connecting bar 77 as it is pivoted to the linkage bar 76 and to the connecting block at 76*b*. In front of the connecting bar 77 there are located two rollers one is a top roller 87 and the other is a lower roller 85. The purpose of each of the rollers is to return a web of material trained around them to thereby make double runs to aid in the deployment of the one half of the seat assembly. In this view there is shown the bottom web 83 and the return web 83*a*. Then there is shown the bottom roller 85. In between the webs there is located a small diameter idler roller 91 and behind the rear unit deployment roller 85 there is located another small diameter 87. Also there is shown an upper boss 88 and a lower boss 89 on the connecting block 78 between which the pivot pin 76*b* is held in place. The forward edge of the one half of the seat assembly has a rigid connecting piece of metal which extends all the way across to the side of this assembly.

Figure 8:
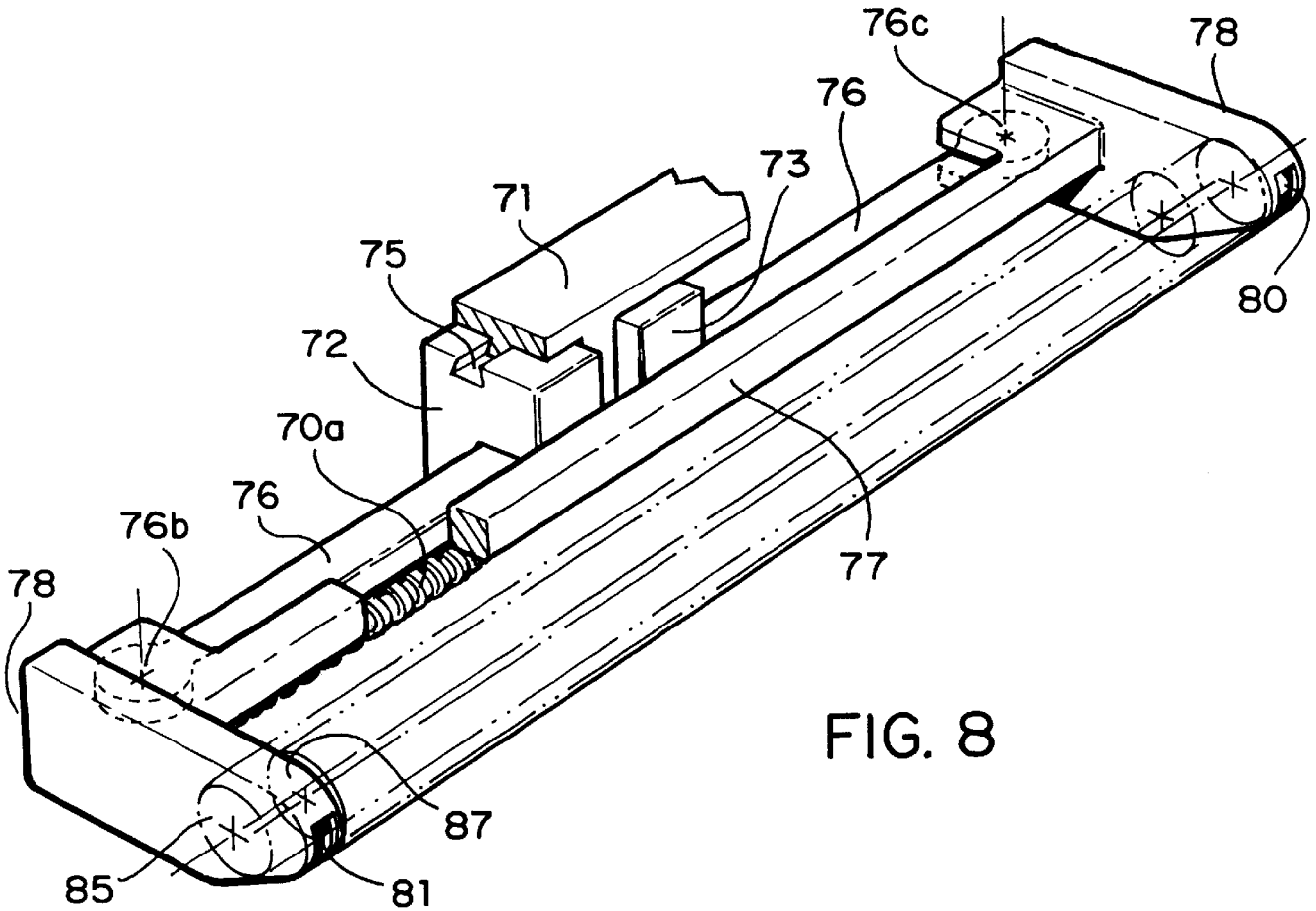
FIG. 8 is a view of one half of the seat assembly in a fully retracted position.

FIG. 8 illustrates the one half of the overall seat assembly in a retracted position. As can be seen, the two sliding blocks 72 and 73 have moved to their respective positions whereby the linkage bars 76 have moved to their respective straight line position. The connection bar 77 has moved to a position wherein it is parallel to the linkage bars 76. The rollers 85 and 87 are located adjacent to the connection bar 77. This view thereby shows that a minimum of space is required between opposed seat assemblies to either dispose of a patient or to pick one up. Again, like reference characters have been applied as in previous Figs.

Figure 9:
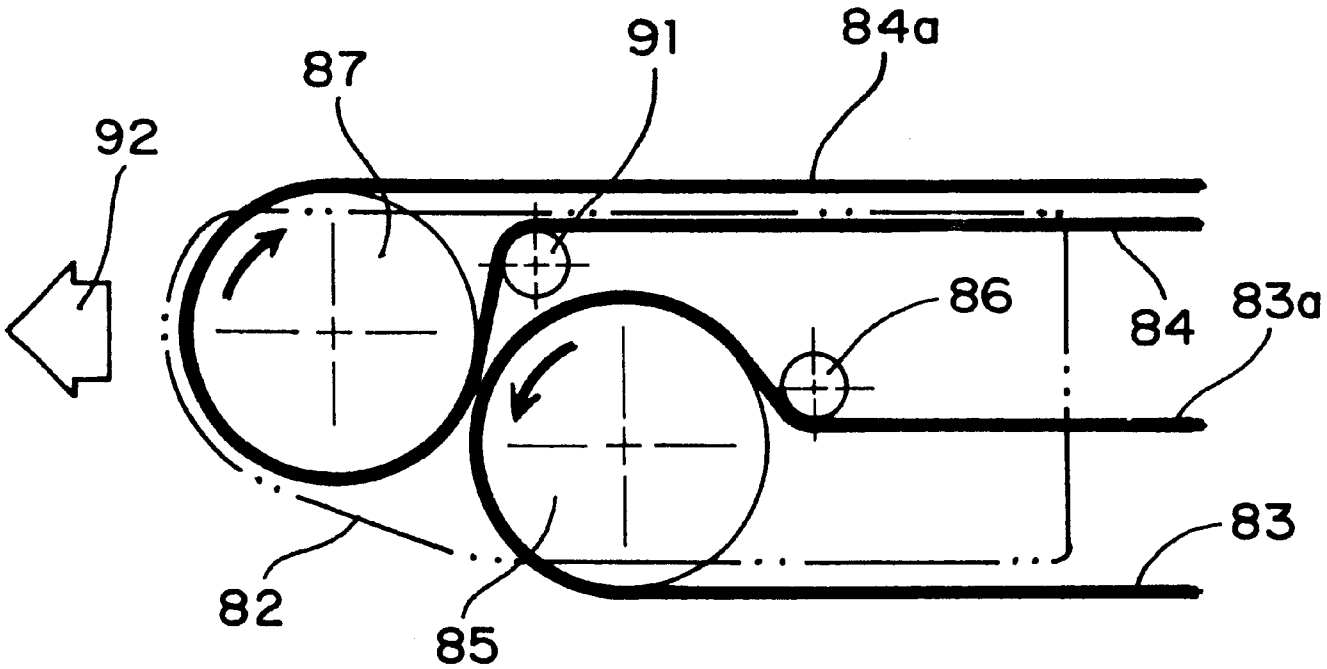
FIG. 9 shows a view of the forward rolls, when extended, as to how the belts are trained around the forward rollers to be moved under a patient.

FIG. 9 illustrates the deployment of belts used in the seat assembly system. As can be seen, there are upper belts and lower belts. The upper belt consists of an upper run 84*a* and a lower run 84 guide around a forward roller 87. The upper run 84*a* extends from is fixed or tethered location while the lower run 84 extends from a tension roller (shown in FIG. 10). The lower run 84 is trained around a small diameter deflection roller so as not to interfere with any other runs of the belt system. The lower belt system consists of a lower run 83 whose end is fixed or tethered around the inner roller 85 and then as a run 83 back to a tension roller which will wind up or pay out the belt material depending on the movement of the seat belt assembly. The arrow 92 in FIG. 9 indicates the movement of the half of the seat assembly. In this case, the upper run 84*a* of the upper belt system is tethered while the lower run 84 is paying out from a tension roller. The lower web system, in this case, is paying out the web from a tension roller with its upper run 83*a* around the roller 85 while the lower run 83 remains tethered. The small diameter roller 86 takes up any slack that may develop in the belt.

Figure 10:
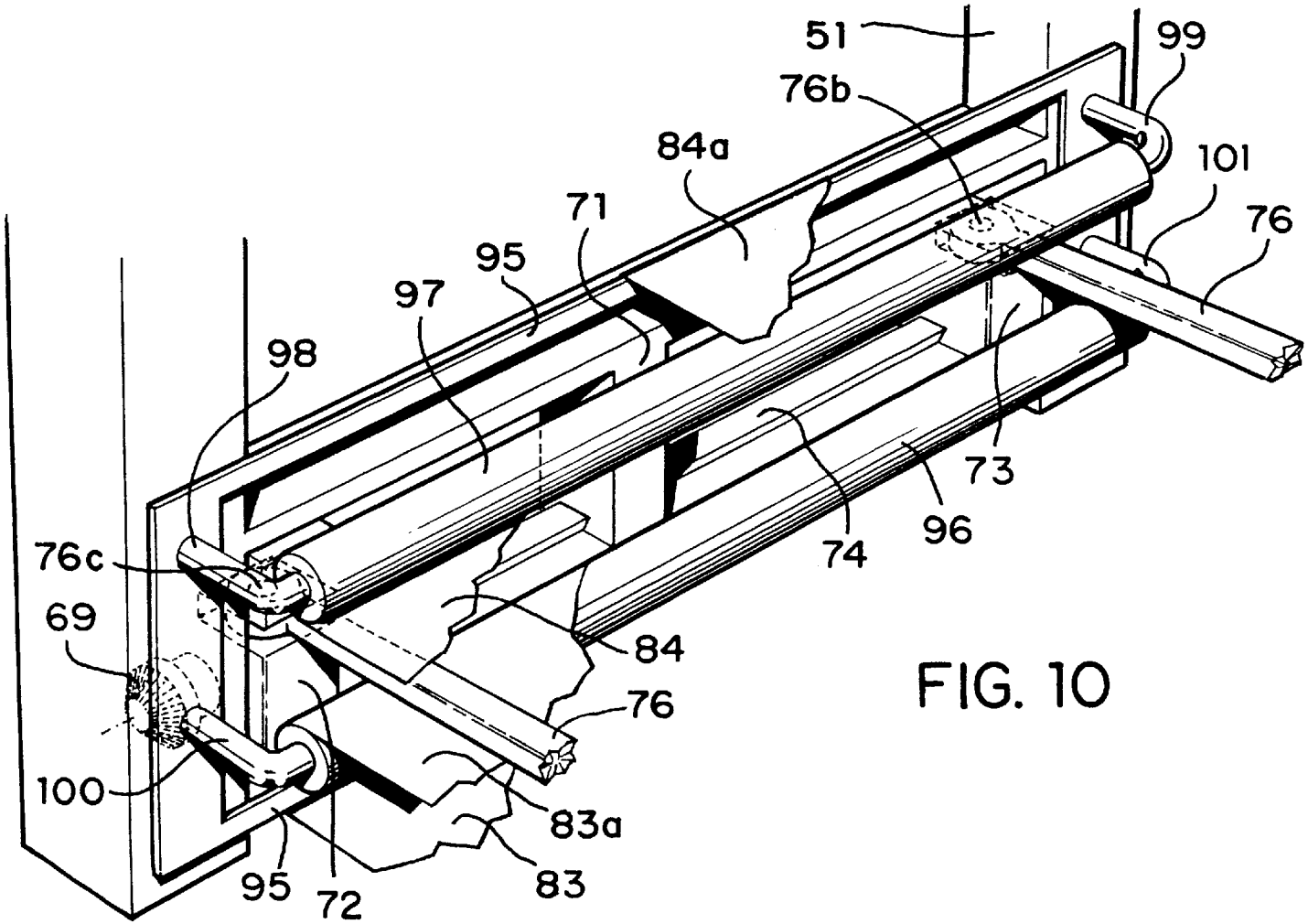
FIG. 10 illustrates the belts as to how they are paid out from tension rollers.

FIG. 10 illustrates the system that controls the payout and the retraction of the two belts 83 and 84. To this end, a plate 95 is mounted in front of the horizontal support block 71 which plate acts as a tether bar to hold the ends of the belts 83 and 84 in a stationary position. The plate 95 also has mounted thereon the left 98 and right 99 upper support brackets to hold the web tension roller 97 there between. At the same time there are the left 100 and the right 101 support brackets which are mounted on the plate 95 at a lower position to hold the support brackets 100 and 101 thereon. The support brackets 100 and 101 hold the tension roller 96 there between which will pay out the belt 83*a* as was explained with reference to FIG. 9. In FIG. 10 there also can be seen right and left outer and vertical housing enclosures 51 and to which the horizontal connecting rod 71 is mounted or attached thereto as well as the tether bar or plate 95. FIG. 10 also illustrates how the linkage bars 76 are connected to their respective stationary points such as 76*b* and 76*c*. This illustration of FIG. 10 also gives a demonstration of the inner ends of the one half of the seat deployment 8 before a patient is being transported.

Figure 11B:
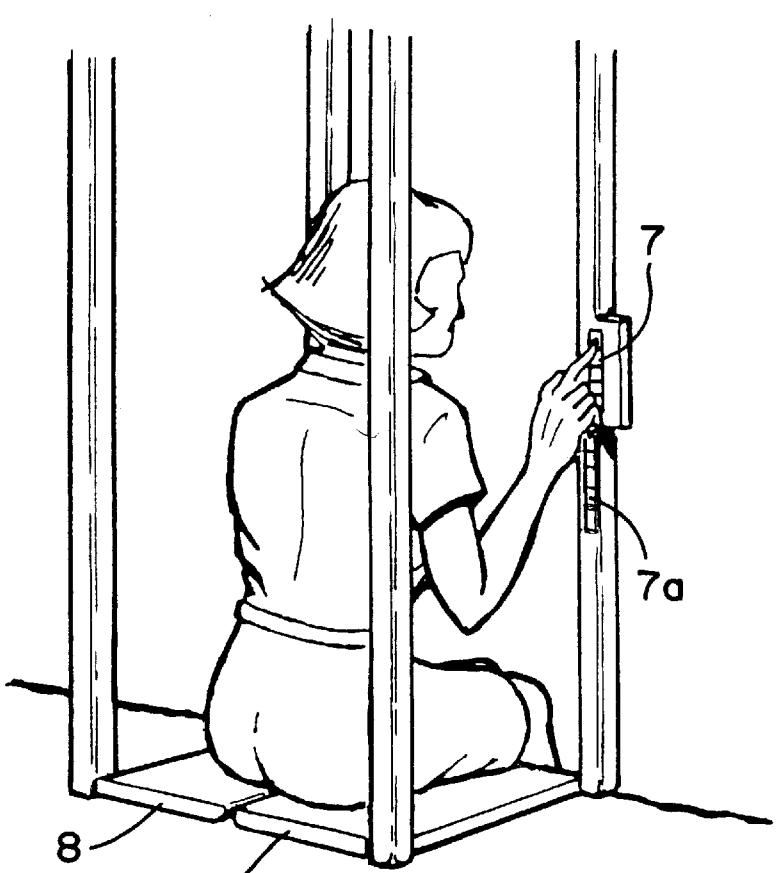
FIG. 11B shows the seat assembly after having been employed under a patient.
Figure 11A:
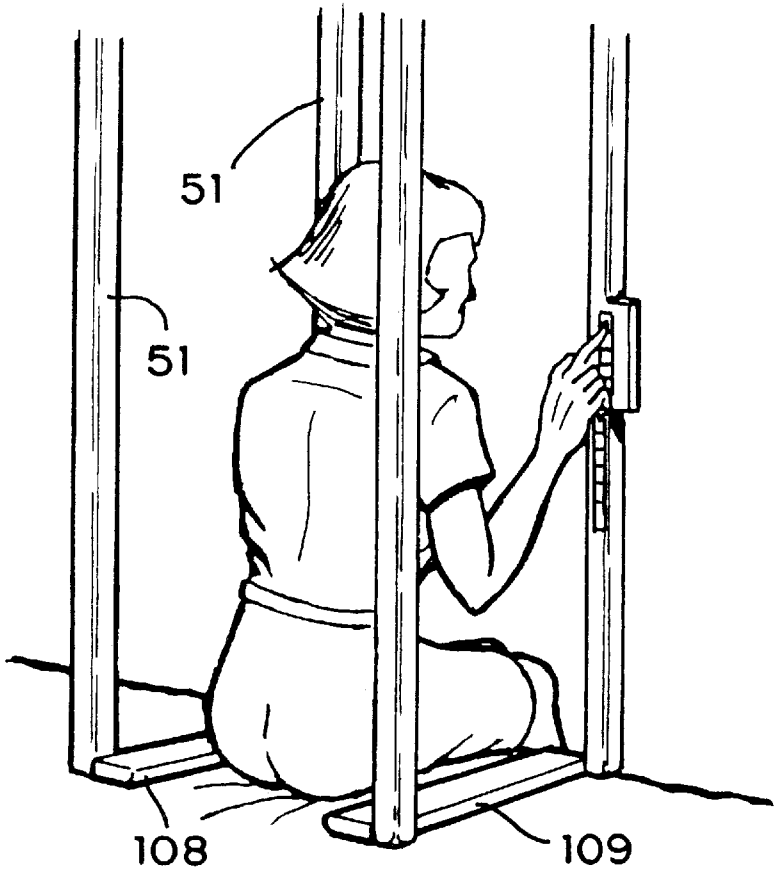
FIG. 11A shows a patient sitting on a support prior to an employment of a seat support.

FIG. 11A illustrates the condition before a patient is being picked up or engaged to be transported to a different location. In this view, the patient is sitting on a bed, a cushion, a wheel chair or even on the floor. Both of the halves of the transport system move under the patient as was explained with reference to FIGS. 7 through 10.

FIG. 11B illustrates the fact that two halves of the seat assemblies 8 and 9 are connected to each other under the patient sitting on the two halves of the patient's seat assembly The control system 7 and 7*a* will control, by way of push buttons, to determine the various motions the overall transfer system 1 will have to undergo the final result and that is to transfer a patient from one point to another point without the help of any intervening structures or any medical assistance help.

Conclusion

It can now be seen from all of the above that the patient transfer system involves at least four motions or movements to transfer a patient from, point A to point B.

The first movement is shown in FIG. 3 wherein the pinion gear 40 which is powered by the motor 39 drives along the track 41 in a straight or curved track 41 from which the overall system is suspended.

The second movement is shown in FIGS. 2 and 3. The ring gear 23 is suspended and fastened to the upper support unit 3 and the motor 15 drives the pinion gears 19 and 20 when engaged by the pivot arm 16.

The third movement is still shown in FIGS. 2 and 3 where the motor 15 drives the chain sprocket 18 when engaged by the gear 21 and 22 when the pivot arm is moved into that position and drives the lower chain 14 around all four corner columns having the sprocket wheels 13 thereon. This movement will rotate downwardly extending shafts 11 which in turn establish the third movement which is an up and down movement of the overall system The fourth movement is derived from the second support unit 4 having a motor 29 therein. This motor, by way of sprocket wheel 13 drives a vertical shaft 11 which is splined to the telescoping shaft 6 having a miter gear 68 thereon which in turn drives the miter gear 69 which is attached to the horizontal drive shaft 70. This drive shaft 70 is instrumental in operating the seat deployment mechanism.

What I claim is:

1. A patient transfer system including a seat assembly adapted to be moved from point A to point B, said transfer system includes means to move said seat assembly in four movements;

a first of said movements moves said seat assembly along and relative to a ceiling from which said seat assembly is suspended;

a second of said movements moves said seat assembly in a rotation relative to said ceiling;

a third of said movements moves said seat assembly in an up and down movement relative to said ceiling;

a fourth of said movements moves said seat assembly so that two halves of a seat move toward each other to move a patient from an implement sitting position to an engaged position to thereby seat said patient on said seat assembly.

2. The seat assembly of claim 1 including a track mounted on said ceiling to induce said first movement, said track including a rack and pinion drive driven by a motor having said pinion therein.

3. The seat assembly of claim 2, wherein said track is mounted in a channel within said ceiling.

4. The seat assembly of claim 2 wherein said track is mounted on a surface of said ceiling.

5. The seat assembly of claim 1, wherein said second movement of rotation is derived from a ring gear mounted non-rotationally within an upper unit which is mounted non rotationally relative to said ceiling but being movable in said first movement relative to said ceiling.

6. The seat assembly of claim 5 including a second support unit having means therein for supporting said second unit for rotation relative to said first support unit, said means for rotation including a switchable gear assembly having multiple gears thereon for engaging said ring gear of said first support unit in a first position.

7. The seat assembly of claim 6, wherein one of the gears of said multiple of gears on said switchable gear unit is driven by a second motor.

8. The seat assembly of claim 6 wherein said second support unit is rotationally suspended from track and rollers on said ring gear.

9. The seat assembly of claim 1, wherein said third movement is derived from a second support unit which is rotationally suspended from a first support unit said second support unit having four corners and having a switchable gear assembly with a multiple of gears thereon being switchable from a first position to a second position, one of said gears on said switchable gear unit is driven by a second motor, said switchable gear unit when moved into a second position will drive another gear having a first chain sprocket wheel fastened thereon, a chain driven by said first chain sprocket wheel will drive second sprocket wheels, each located at each of said corners, each of said second sprocket wheels located at each of said corners drives a first hollow, vertically and downwardly extending shaft.

10. The seat assembly of claim 9 including a second hollow shaft located within said first hollow shaft, said first and second hollow shafts are connected to each other by male and female helical gear threads, said first hollow shaft when being rotated will move said second hollow shaft in a vertical movement relative to said hollow shaft including a horizontal housing connected thereto.

11. The seat assembly of claim 10, wherein said second hollow shaft is connected to a first cylindrical housing which slides in a second cylindrical housing fastened to said second support unit.

12. The seat assembly of claim 10 including said fourth movement which is derived from said second support unit having a third motor fastened thereon, said motor having a third chain sprocket mounted thereon driving a fourth sprocket wheel affixed thereto which drives a third hollow shaft which extends into said second hollow shaft and in relative rotation therewith.

13. The seat assembly of claim 12 including a rigid shaft extending into said third hollow shaft and in a fixed rotation therewith but being slidable relative thereto by way of male and female splines affixed between an inside of said third hollow shaft and said rigid shaft.

14. The seat assembly of claim 13, wherein said rigid shaft has a first miter gear attached thereto to drive a second miter gear on a horizontal drive shaft supported in said horizontal housing.

15. A patient transfer system including a seat assembly having four movements including a first movement to move said seat assembly from point A to point B, a first means for moving said seat assembly relative to a ceiling from which said seat assembly is suspended, a second means for moving said seat assembly in a rotational movement relative to said ceiling, a third means for moving said seat assembly in an up and down movement relative to said ceiling, a fourth means for moving two sections of a seat to complete a whole seat under a patient to sit on and then to be transported.

16. The transfer system of claim 15 including a vertical drive derived from a first support unit mounted on said ceiling and a second support unit having four corners mounted to said first support unit, said second support unit having said vertical drive included therein, said vertical drive having at a bottom end thereof a first miter gear included in said drive, a second miter gear being driven by said first miter gear and driving a horizontal shaft mounted in a horizontal housing at a bottom of said transfer system.

17. The transfer system of claim 16 wherein said horizontal housing is connected to an identical vertical drive at another corner of said transfer system said horizontal shaft is connected to two sliding blocks sliding in said horizontal housing, said sliding blocks are driven by a double sided helical screw as an extension of said horizontal shaft, whereby said sliding blocks move into opposite directions when said horizontal shaft is activated.

18. The transfer system of claim 17 including two transfer linkages each attached to each of said sliding blocks at one end and an another end is attached to a forward connecting bar, whereby, when the sliding blocks move in opposite directions, linkages driven by said sliding blocks will move said connecting bar forward and into an extended position.

19. The transfer system of claim 18, wherein said connecting bar has an end closure block attached to each end thereof, each of said end closure blocks having an upper and forward roller located therein and a lower and rearward roller located therein.

20. The transfer system of claim 19 including a double belt system, the first belt system consisting of a belt having a lower run tethered to said end closure block to continue around said lower and rearward roller and back to a tension roller mounted on said end closure block, the second belt system consists of an upper run which is tethered to said end closure block to continue around said forward and upper roller and then back to a tension roller mounted on said end closure block thereby, when said linkages are extended, both of said belt systems are driven under a patient sitting on a support or the said patient.

21. The support system of claim 20, wherein a duplicate or second belt system is located opposite said first belt system, means for moving said first and said second belt system in unison, whereby said two systems will meet in the middle under said patient to complete a seat, means on each of said belt systems to lock the same into a rigid configuration.

22. The support system of claim 21, wherein means for locking said two belt systems together includes a male connecting bolt extending from a forward end of one of said belt systems and female receptacle placed within a forward end of said second belt system.

23. The support system of claim 15 including a control panel mounted on a vertical support of said support system for controlling all four of said movements from a central location, said control panel eliminates any manual assist of a second or more persons.

* * * * *